US010403206B2

(12) United States Patent
Kim et al.

(10) Patent No.: US 10,403,206 B2
(45) Date of Patent: Sep. 3, 2019

(54) DISPLAY PANEL AND DISPLAY DEVICE INCLUDING THE SAME

(71) Applicant: Samsung Display Co., Ltd., Yongin-si, Gyeonggi-Do (KR)

(72) Inventors: Jung-Hak Kim, Hwaseong-si (KR); Hyung-Jun An, Hwaseong-si (KR); Kwang-Deuk Jang, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 101 days.

(21) Appl. No.: 15/411,159

(22) Filed: Jan. 20, 2017

(65) Prior Publication Data

US 2017/0213489 A1 Jul. 27, 2017

(30) Foreign Application Priority Data

Jan. 21, 2016 (KR) ..... 10-2016-0007641

(51) Int. Cl.
*G09G 3/3258* (2016.01)
*G09G 3/20* (2006.01)
*G09G 3/3233* (2016.01)

(52) U.S. Cl.
CPC ..... *G09G 3/3258* (2013.01); *G09G 3/20* (2013.01); *G09G 3/3233* (2013.01); *G09G 2300/0465* (2013.01); *G09G 2300/0861* (2013.01); *G09G 2330/08* (2013.01); *G09G 2330/12* (2013.01)

(58) Field of Classification Search
CPC .. G09G 3/006; G09G 3/3258; G09G 2330/12; G09G 3/20; G09G 3/3233; G09G 2330/08; G09G 2330/0861; G09G 2330/0465
See application file for complete search history.

(56) References Cited

U.S. PATENT DOCUMENTS

2006/0192752 A1* 8/2006 Ando ..... G09G 3/006 345/156
2009/0219238 A1* 9/2009 Furuya ..... G09G 3/006 345/87
2013/0235016 A1* 9/2013 Seo ..... G09G 3/3208 345/212
2013/0335397 A1* 12/2013 Kim ..... G09G 3/006 345/212

FOREIGN PATENT DOCUMENTS

KR 10-2010-0098925 A 9/2010
KR 10-2014-0141276 A 12/2014

* cited by examiner

*Primary Examiner* — Brent D Castiaux
(74) *Attorney, Agent, or Firm* — Innovation Counsel LLP

(57) ABSTRACT

A display panel includes a plurality of pixels; a plurality of light emission control signal lines configured to transfer a light emission control signal to control light emission times of the plurality of pixels through an end of the plurality of light emission control signal lines to the light emission control signal to the plurality of pixels, respectively; and a detection circuit configured to generate a detection signal based on light emission detection signals, the detection circuit being electrically connected to the other end of the plurality of light emission control signal lines, where the detection signal indicates an occurrence of an internal damage of the display panel.

14 Claims, 7 Drawing Sheets

DISPLAY PANEL AND DISPLAY DEVICE INCLUDING THE SAME

CROSS-REFERENCE TO RELATED APPLICATION(S)

This application claims priority under 35 USC § 119 to Korean Patent Application No. 10-2016-0007641, filed on Jan. 21, 2016 in the Korean Intellectual Property Office (KIPO), the disclosure of which is incorporated herein in its entirety by reference.

BACKGROUND

1. Technical Field

The present disclosure relates to a display device, more particularly, to a display panel and a display device including a display panel.

2. Description of the Related Art

A display panel includes pixels located in cross-regions of scan lines and data lines. When scan signals are sequentially provided to the scan lines, data signals provided through the data lines are stored in the pixels in response to the scan signals. The pixels emit light with luminance corresponding to the data signals.

As a resolution of the display panel increases, lines (e.g., the scan lines, the data lines) of the display panel are more adjacent to each other, and a gap between the adjacent lines becomes narrower. Therefore, cracks due to physical damage to the display panel occur more frequently. In addition, a short between the adjacent lines may occur causing an excessive current to flow through the lines and damaging the display panel.

A display device may detect the cracks by forming a crack sensing line that surrounds a pixel area where the pixels are located. However, the display device is not able to detect a crack in the pixel area, and a size of non-display area where no pixel is located increases due to the additional lines such as the crack sensing line.

SUMMARY

Some example embodiments provide a display panel that can detect cracks without increasing a size of a pixel area.

Some example embodiments provide a display device including the display panel.

According to example embodiments, a display panel may include a plurality of pixels; a plurality of light emission control signal lines configured to transfer a light emission control signal to control light emission times of the plurality of pixels through an end of the plurality of light emission control signal lines to the plurality of pixels, respectively; and a detection circuit configured to generate a detection signal based on light emission detection signals. The detection circuit is electrically connected to the other end of the plurality of light emission control signal lines, and the detection signal indicates an occurrence of an internal damage of the display panel.

In example embodiments, the detection circuit may generate a first detection signal based on a first light emission detection signal output from a first light emission control signal line of the plurality of light emission control signal lines and a second light detection control signal output from a second light emission control signal line of the plurality of light emission control signal lines, where the detection signal includes the first detection signal.

In example embodiments, the plurality of light emission control signal lines may extend in a first direction and may be arranged along a second direction perpendicular to the first direction.

In example embodiments, the detection circuit may be located on a first side of the display panel.

In example embodiments, each of the plurality of pixels may include a first transistor including a first electrode electrically connected to a first power voltage, a second electrode electrically connected to a first node, and a gate electrode receiving a data signal; a second transistor including a first electrode electrically connected to the first node, a second electrode electrically connected to a second node, and a gate electrode receiving the first light emission control signal; and a light emission element electrically connected between the second node and a second power voltage.

In example embodiments, the detection circuit may output the first detection signal by performing a logical multiplication operation of the first light emission detection signal and the second light emission detection signal.

In example embodiments, the detection circuit may include a logic gate element to receive the first light emission detection signal and the second light emission detection signal and to output the first detection signal.

In example embodiments, the detection circuit may generate a second detection signal based on a third light emission detection signal output from a third light emission control signal line of the plurality of light emission control signal lines.

In example embodiments, the detection circuit may generate a second detection signal based on a third light emission detection signal output from a third light emission control signal line of the plurality of light emission control signal lines and a fourth light emission detection signal output from a fourth light emission control signal line of the plurality of light emission control signal lines.

In example embodiments, the detection circuit may generate the detection signal based on the first detection signal and the second detection signal.

In example embodiments, the detection circuit may generate the detection signal using a logical multiplication operation of the first detection signal and the second detection signal.

In example embodiments, the detection circuit may include a logic gate element configured to receive the first detection signal and the second detection signal and to output the detection signal.

According to example embodiments, a display device may include a display panel including a plurality of pixels and a plurality of light emission control signal lines respectively transferring a light emission control signal to control light emission times of the plurality of pixels; and a logical gate driver configured to generate detection signal based on light emission detection signals; and a controller configured to generate the light emission control signal, to provide the light emission control signal to another end of the plurality of light emission signal lines, and to determine an occurrence of an internal damage based on the detection signal. The logical gate driver is electrically connected to the other end of the plurality of light emission control signal lines In example embodiments, the plurality of light emission control signal lines may extend in a first direction and may be arranged along a second direction perpendicular to the first direction.

In example embodiments, the logical gate driver may generate the detection signal based on a first light emission detection signal output from a first light emission control signal line of the plurality of light emission control signal lines and a second light emission detection signal output from a second light emission control signal line of the plurality of light emission control signal lines.

In example embodiments, the controller may compare the detection signal and a reference signal and may determine that the internal damage has occurred in the display panel when a waveform of the detection signal is different from a waveform of the reference signal.

In example embodiments, the controller may include a signal generator configured to generate the light emission control signals; and a determiner configured to determine the occurrence of the internal damage based on the detection signal.

In example embodiments, the signal generator may generate the reference signal having an inverted waveform with respect to a waveform of the light emission control signal, and the determiner may determine the occurrence of the internal damage using a logical operation of the detection signal and the reference signal.

In example embodiments, the signal generator may perform a logical sum operation of the detection signal and the reference signal.

In example embodiments, the display device may further include a power supply configured to provide driving voltages to the plurality of pixels. The controller may generate a power control signal to control a supply of the driving voltages based on a result of determination of the occurrence of the internal damage and may provide the power control signal to the power supply.

Therefore, a display panel according to example embodiments may detect internal damage of a display panel by generating a detection signal based on light emission control signals to control a light emission time of the plurality of pixels.

In addition, a display device according to example embodiments may minimize an increase in a size of a non-display area in which additional lines are formed because the display device does not require the additional lines for detecting an internal damage or a crack).

Furthermore, the display device according to example embodiments may detect internal damage of a display area during driving of the display device.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Hereinafter, the present disclosure will be explained in detail with reference to the accompanying drawings.

Figure 1:
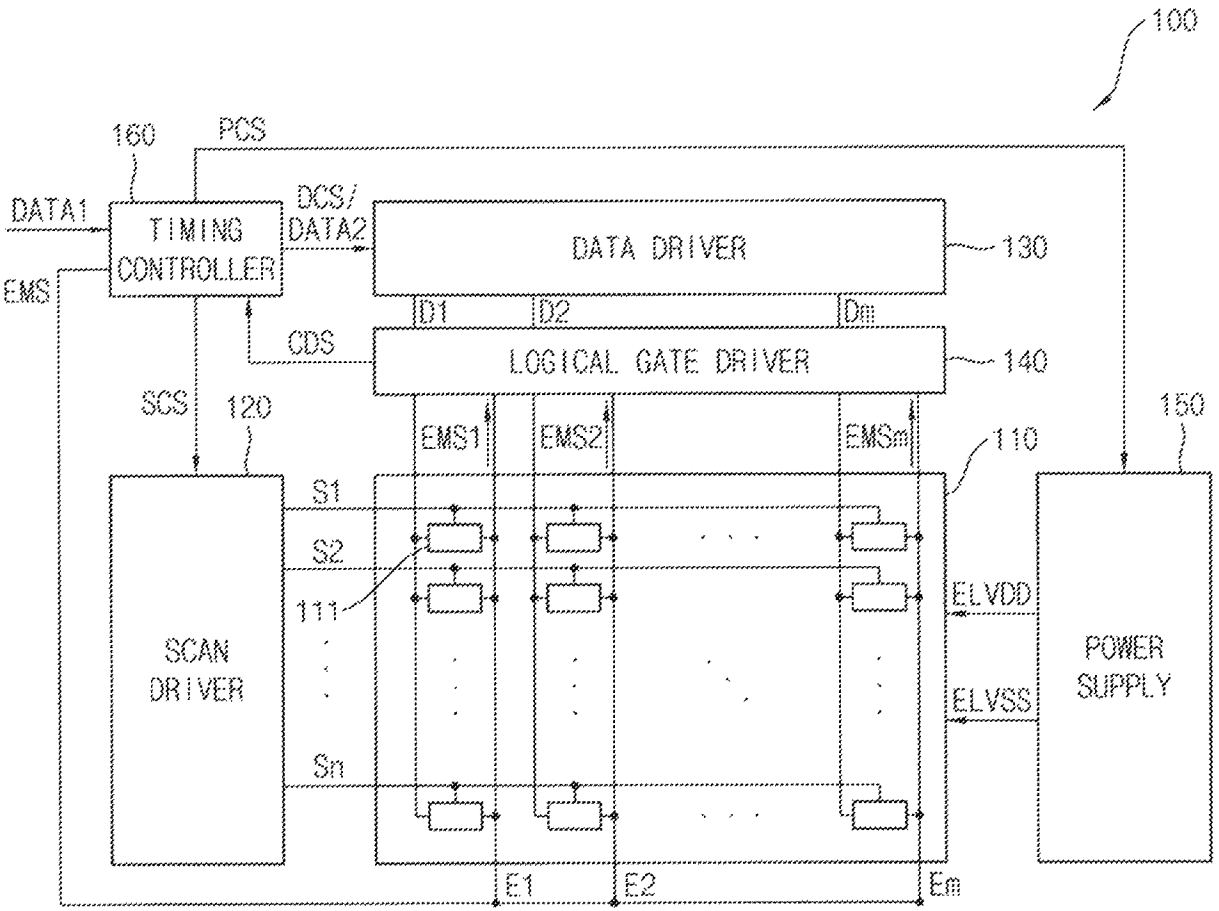
FIG. 1 is a block diagram illustrating a display device, according to example embodiments.

FIG. 1 is a block diagram illustrating a display device, according to example embodiments.

Referring to FIG. 1, the display device 100 may include a display panel 110, a scan driver 120, a data driver 130, a logical gate driver 140, a power supply 150, and a timing controller 160. The display device 100 may display an image based on image data (e.g., first image data DATA1) provided from an external component. For example, the display device 100 may be an organic light emitting display (OLED) device.

The display panel 110 may include gate lines S1 through Sn, data lines D1 through Dm, light emission control signal lines E1 through Em, and pixels 111, where each of n and m is an integer greater than or equal to 2. Here, the light emission control signal lines E1 through Em may transfer a light emission control signal EMS to control an emission time of the pixels 111. For example, the light emission control signal lines E1 through Em may receive the light emission control signal EMS from an external component (e.g., the timing controller 160) through an end (or a terminal) and may transfer the light emission control signal EMS to the pixels 111.

The pixels 111 may be located in cross-regions of the gate lines S1 through Sn, the data lines D1 through Dm, and the light emission control signal lines E1 through Em, respectively. The pixels 111 may store data signals in response to scan signals and may emit light based on the stored data signals. The pixels 111 may emit light for a certain time in response to the light emission control signals EMS.

The scan driver 120 may generate the scan signals based on a scan driving control signal SCS. The scan driving control signal SCS may include a start signal (or a start pulse) and clock signals, and the scan driver 120 may include shift registers sequentially generating the scan signals based on the start signal and the clock signals.

The data driver 130 may generate the data signals based on the image data (e.g., second image data DATA2). The data driver 130 may provide the display panel 110 with the data signals in response to the data driving control signal DCS.

The logical gate driver 140 (or AND-gate driver, a detection circuit) may be electrically connected to the other end (or the other terminal) of the light emission control signal lines E1 through Em and may generate a detection signal CDS based on light emission detection signals EMS1 through EMSm (or output light emission signals) that are output signals of the light emission control signal lines E1 through Em from the display panel 110 after traversing through the display panel 110. The detection signal CDS may indicate an occurrence of internal damage (e.g., cracks) of the display panel 110.

In some example embodiments, the logical gate driver 140 may output the detection signal CDS by performing a logic operation on the light emission detection signals EMS1 through EMSm. For example, the logical gate driver 140 may include logical gates (or logic gate elements, logical operators such as logic AND gates) and may output the detection signal CDS by performing a logical multiplication operation (e.g., "AND") of the light emission detection signals EMS1 through EMSm.

The power supply 150 may generate driving voltages and provide the driving voltages to the display panel 110 (or the pixels 111). The driving voltages may be a power voltage to drive the pixels 111. For example, the driving voltages may include a first power voltage ELVDD and a second power voltage ELVSS. The first power voltage ELVDD may have a voltage level greater than a voltage level of the second power voltage ELVSS.

In some example embodiments, the power supply 150 may stop a power supply (or a supply of the driving voltages) to the display panel 110 in response to a power control signal PCS. Here, the power control signal PCS may be provided from the timing controller 160.

The timing controller 160 may control the scan driver 120 and the data driver 130. The timing controller 160 may generate the scan driving control signal SCS and the data driving control signal DCS and may control the scan driver 120 and the data driver 130 based on the generated signals.

In some example embodiments, the timing controller 160 may generate the light emission control signal EMS and provide the light emission control signal EMS to the pixels 111 through the light emission control signal lines E1 through Em. The timing controller 160 may receive the detection signal CDS from the logical gate driver 140 and may determine an occurrence of an internal damage of the display panel 110 based on the detection signal CDS.

For example, the timing controller 160 may compare the detection signal CDS and a reference signal and may determine that an internal damage (or cracks) has occurred in the display panel 110 when the detection signal CDS has a waveform different from a waveform of the reference signal. The reference signal may have the waveform that is the same or substantially same as a waveform of the light emission control signal EMS.

The light emission control signal EMS is provided to the light emission control signal lines E1 through EM. The light emission detection signals EMS1 through EMSm that are output from the display panel 110 through the light emission control signal lines E1 through Em may have a waveform that is the same as the waveform of the light emission control signal EMS when no internal damage occurs in the display panel 110 (e.g., no cracks occur in the light emission control signal lines E1 through Em). For example, when an internal damage (or a crack) occurs in a first light emission control signal line E1 of the display panel 110, the resistance of the first light emission control signal line E1 may be changed. As a result, the first light emission detection signal EMS1 may have a waveform that is different from a waveform of the reference signal (or the waveform of the light emission control signal EMS, other light emission detection signals EMS2 through EMSm) because the first light emission control line E1 have the resistance that is different from the resistances of other light emission detection signals EMS2 through EMSm. Therefore, the timing controller 160 may determine that an internal damage (or a crack) has occurred in the display panel 110 when the detection signal CDS has a waveform different from the waveform of the reference signal.

In this case, the timing controller 160 may generate the power control signal PCS, and the power supply 150 may stop a power supply to the display panel 110 in response to the power control signal PCS.

As described above, the display device 100 according to example embodiments may detect an internal damage of the display panel 110 by generating the detection signal CDS based on the light emission detection signals EMS1 through EMSm that are output signals of the light emission control signal lines E1 through Em from the display panel 110 after traversing through the display panel 110.

In addition, the display device 100 may minimize an increase in a size of the display panel 110 (a non-display area or a dead space) in which additional lines are formed because the display device 100 does not require the additional lines for detecting an internal damage of the display panel 110.

Furthermore, the display device 100 may detect an internal damage of the display panel 110 using the light emission detection signals EMS1 through EMSm driving of the display device 100.

In the example shown in FIG. 1, the display device 100 is described as generating the detection signal CDS based on the light emission detection signals EMS1 through EMSm. However, the display device 100 is not limited thereto. For example, the display device 100 may generate the detection signal CDS by sequentially performing a logical operation (e.g., a logical sum operation (also referred to as "OR")) of the scan signals. The scan signals are sequentially provided to one side of the display panel 110 through the scan lines S1 through Sn, and are output through the other side of the display panel 110. The display device 100 may detect an internal damage of the display panel 110 by comparing the detection signal CDS and a reference signal that is measured when no internal damage occurs in the display panel 110.

In addition, the display device 100 is described as generating the light emission control signal EMS using the timing controller 160 and generating the power control signal PCS based on the detection signal CDS. However, the display device 100 is not limited thereto. For example, the display device 100 may include a controller (e.g., a light emission control driver) that can generate the light emission control signal EMS and the power control signal PCS.

Figure 2A:
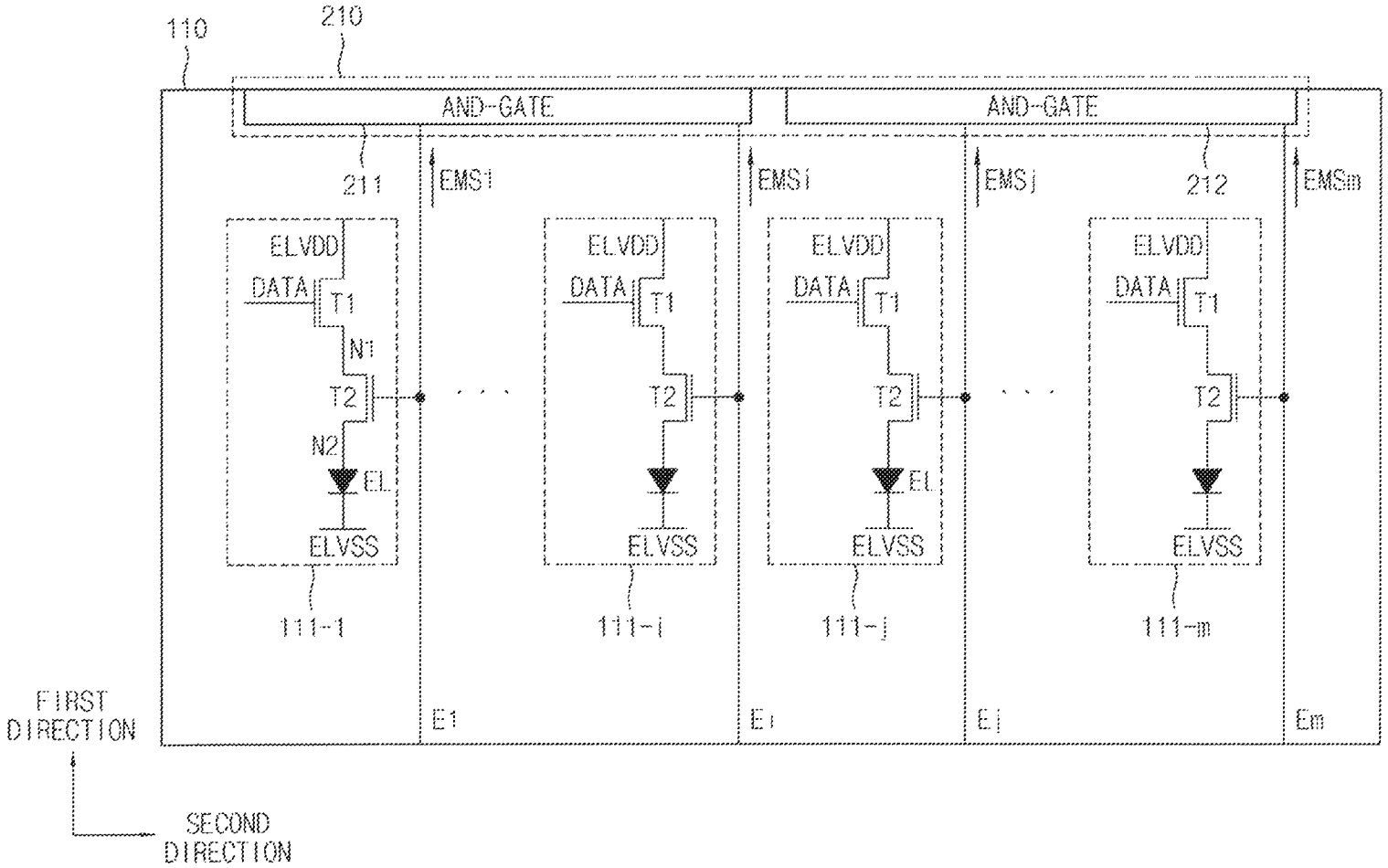
FIGS. 2A, 2B and 2C are circuit diagrams illustrating an example of a display panel included in the display device of FIG. 1.
Figure 2B:
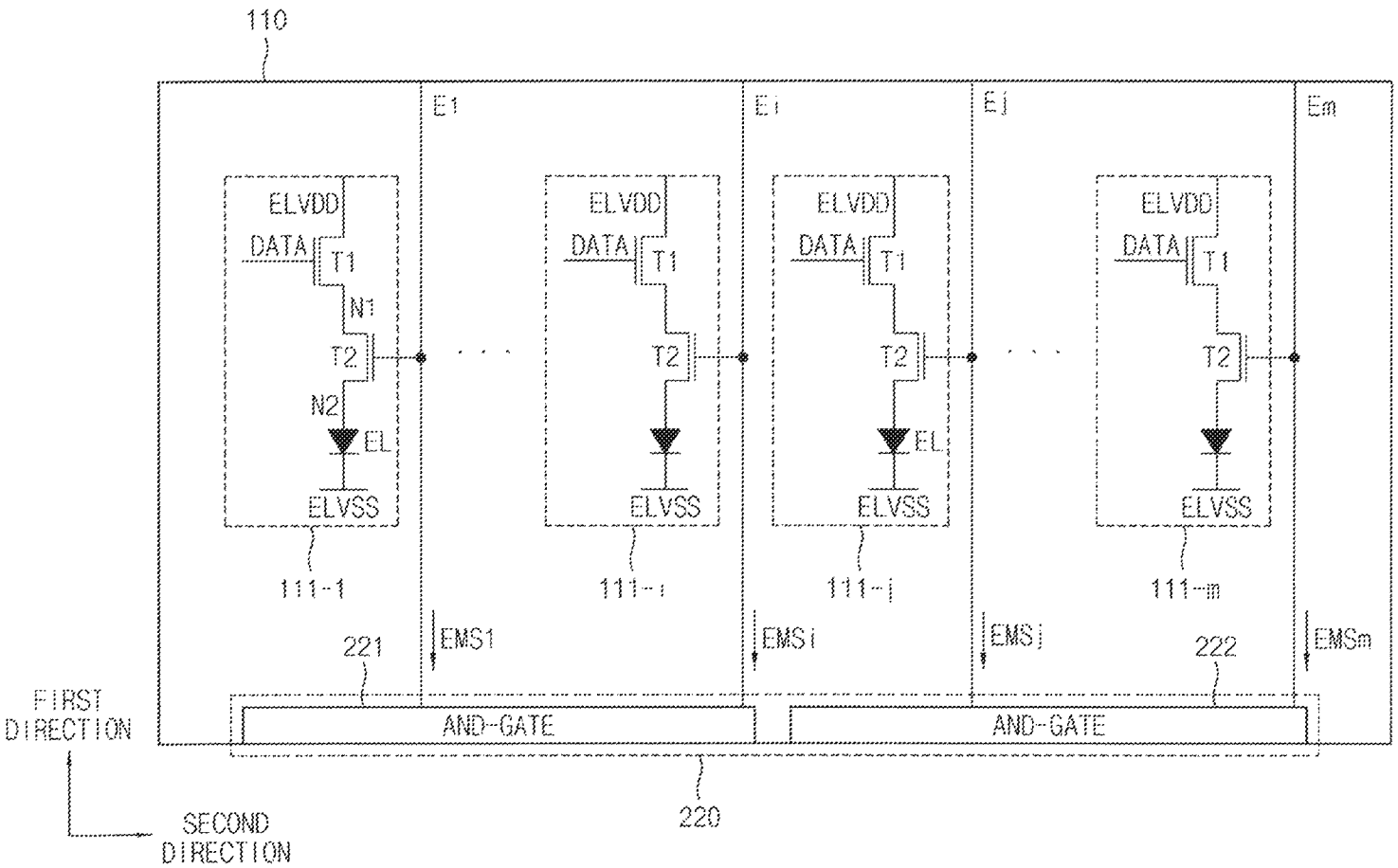
Figure 2C:
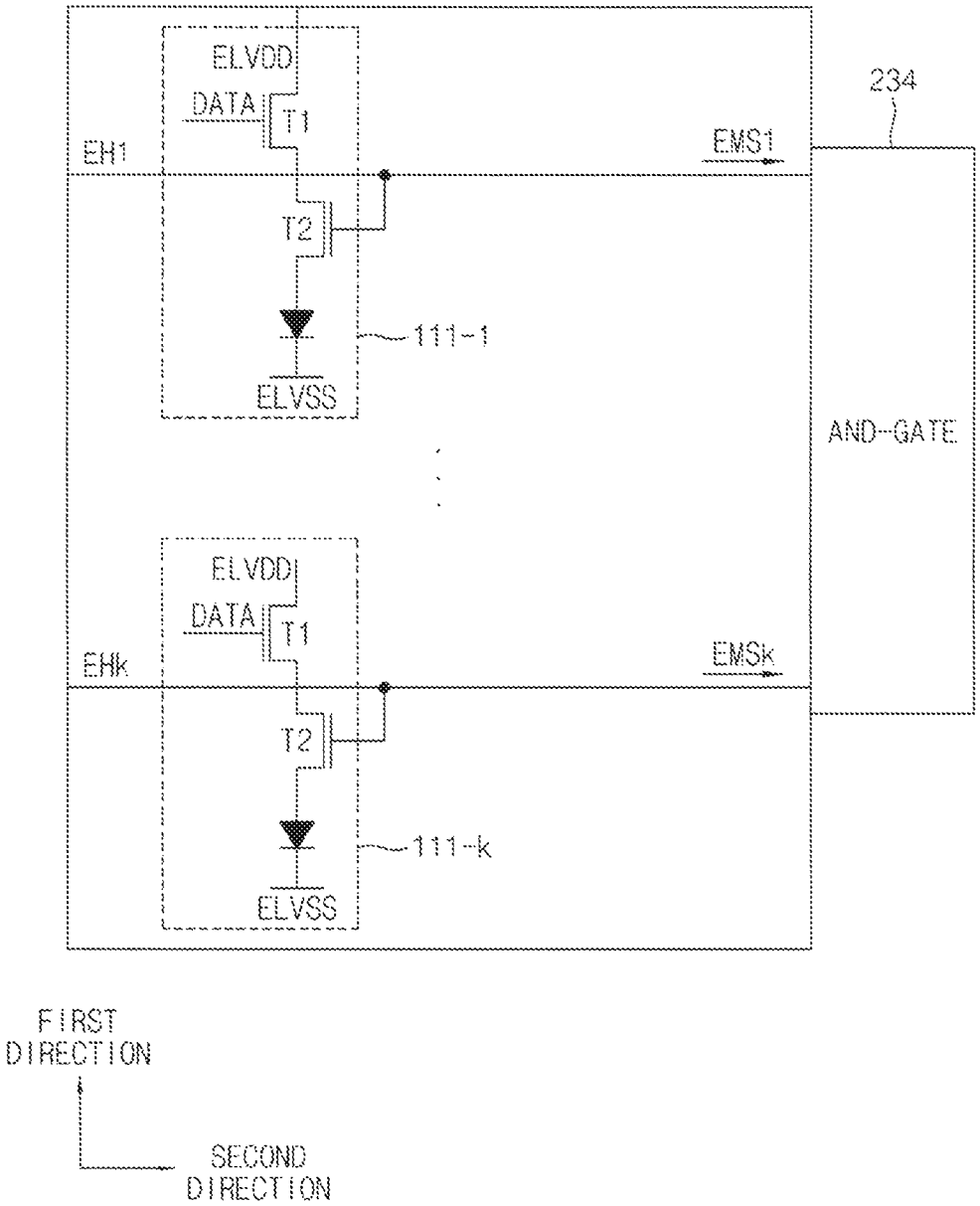

FIGS. 2A through 2C are circuit diagrams illustrating an example of a display panel included in the display device of FIG. 1.

Referring to FIGS. 1 and 2A, the display panel 110 may include pixels 111-1 through **111-*m*, the light emission control signal lines E1 through Em, and a detection circuit 210**.

The pixels 111-1 through ill-m may be the same as or substantially the same as the pixels 111 shown in FIG. 1. Each of the pixels 111-1 through **111-*m* may include a first transistor T1, a second transistor T2, and a light emission element EL. The first transistor T1 may include a first electrode electrically connected to the first power voltage ELVDD, a second electrode electrically connected to a first node N1, and a gate electrode receiving a data signal DATA. The second transistor T2 may include a first electrode electrically connected to the first node N1, a second electrode electrically connected to a second node N2, and a gate electrode receiving a light emission control signal EMS. The light emission element EL may be electrically connected between the second node N2** and the second power voltage ELVSS and emit light in response to the data signal DATA and the light emission control signal EMS. For example, the light emission element EL may be an organic light emitting diode.

The light emission control signal lines E1 through Em may extend in a first direction and may be arranged along a second direction. The second direction may be perpendicular to the first direction. For example, a first light emission control signal line E1 may extend in the first direction, and a second light emission control signal line E2 may be spaced apart from the first light emission control signal line E1 in the second direction. The light emission control signal lines E1 through Em may transfer light emission control signal EMS to the pixels 111-1 through **111-*m***.

The light emission control signals provided to the light emission control signal lines E1 through Em may have the same waveform. It is illustrated in FIG. 1 that the first through mth light emission control signals are transferred independently from each other. However, as described with reference to FIG. 1, the first through mth light emission control signals may be the same as the light emission control signal EMS provided from the timing controller 160. That is, the first through mth light emission control signals provided to the display panel 110 may be the same waveform.

For reference, the light emission control signal EMS may control a light emission time of the pixels 111-1 through **111-*m*. For example, the display device may reduce power consumption by reducing a light emission time of the pixels 111-1 through 111-*m***.

The first through mth light emission detection signals EMS1 through EMSm that are output from the display panel 110 may have the same waveform or different waveforms. That is, the first through mth light emission detection signals EMS1 through EMSm that are output in the first direction with respect to the display panel 110 (or in an upper side of the display panel 110) may have different waveform according to the resistances of the first through mth light emission control signal lines E1 through Em.

The detection circuit 210 may generate the detection signal CDS based on the first through mth light emission detection signals EMS1 through EMSm. The detection signal CDS may indicate an occurrence of an internal damage (or a crack) in the display panel 110. The detection circuit 210 may have a function that is the same as a function of the logical gate driver 140 shown in FIG. 1. The logical gate driver 140 may be implemented as the detection circuit 210 and included in the display panel 110.

In some example embodiments, the detection circuit 210 may include a first AND gate 211 (or a first logic AND gate or a first logical AND operator) and a second AND gate 212.

The first AND gate 211 may output a first detection signal (or a first sub detection signal) by performing a logical operation of the first through ith light emission detection signals EMS1 through EMSi, where i is a positive integer greater than or equal to 2 and i is smaller than m. For example, the first AND gate 211 may be implemented as a logical gate element and perform a logical multiplication operation (AND) of the first through ith light emission detection signals EMS1 through EMSi.

The second AND gate 212 may output a second detection signal (or a second sub detection signal) by performing a logical operation of the jth through mth light emission detection signals EMSj through EMSm, where j is a positive integer greater than i and j is smaller than or equal to m. For example, the second AND gate 212 may be implemented as a logical gate element and perform a logical multiplication operation (AND) of the jth through mth light emission detection signals EMSj through EMSm.

Although it is not illustrated in FIG. 2A, the detection circuit 210 may include a third AND gate. The third AND gate may output the detection signal CDS by performing a logical operation of the first detection signal (i.e., the first detection signal output from the first AND gate 211) and the second detection signal (i.e., the second detection signal output from the second AND gate 212).

In FIG. 2, the second AND gate 212 outputs the second detection signal by performing a logical operation of the jth through mth light emission detection signals EMSj through EMSm. However, the second AND gate 212 is not limited thereto. For example, the second AND gate 212 may receive the mth light emission detection signal EMSm and output the detection signal CDS by performing a logical operation of the first detection signal and the mth light emission detection signal EMSm. The second AND gate 212 may be performed as the third AND gate.

Referring to FIGS. 2A and 2B, the display panel 110 illustrated in FIG. 2B may be substantially the same as the display panel 110 illustrated in FIG. 2A except a location of a detection circuit 220.

The detection circuit 220 illustrated in FIG. 2B may be the same as or substantially the same as the detection circuit 210. That is, the detection circuit 220 may output the detection signal CDS by performing a logical operation of the first through mth light emission detection signals EMS1 through EMSm.

The detection circuit 210 illustrated in FIG. 2A may be located on an upper side of the display panel 110. The light emission control signals may be provided to a lower side of the display panel 110 and may be transferred to the upper side of the display panel 110 (or in the first direction). On the other hand, the detection circuit 220 illustrated in FIG. 2B may be located on the lower side of the display panel 110. Here, the light emission control signals may be provided to the upper side of the display panel 110 and may be transferred to the lower side of the display panel 110 (or in a direction opposite to the first direction).

Referring to FIGS. 2A and 2C, the display panel 110 illustrated in FIG. 2C may be substantially the same as the display panel 110 illustrated in FIG. 2A except locations of horizontal light emission control signal lines EH1 through EHk and except a location of a fourth AND gate 234, where k is a positive integer.

The horizontal light emission control signal lines EH1 through EHk may be substantially the same as the light emission control signal lines E1 through Em illustrated in FIG. 2A. The horizontal light emission control signal lines EH1 through EHk may extend in the second direction and may be arranged along the first direction. For example, a first horizontal light emission control signal line EH1 may extend in the second direction, and a kth horizontal light emission control signal line EHk may be spaced apart from the first horizontal light emission control signal line EH1 in the first direction. The horizontal light emission control signal lines EH1 through EHk may transfer the light emission control signals to the pixels 111-1 through **111-*k***.

The fourth AND gate 234 may be substantially the same as the first AND gate 211 shown in FIG. 2A. The fourth AND gate 234 may output a fourth detection signal by performing a logical operation of the first through ith light emission detection signals EMS1 through EMSi.

As described with reference to FIGS. 2A through 2C, the display panel 110 according to example embodiments may include the detection circuit 210 that generates the detection signal CDS based on the light emission detection signals EMS1 through EMSm. Therefore, the display panel 110 may detect or may enable to detect an internal damage of the display panel 110. The detection circuit may 210 be located on an upper side, a lower side, a left side, or any other parts of the display panel 110.

Figure 3:
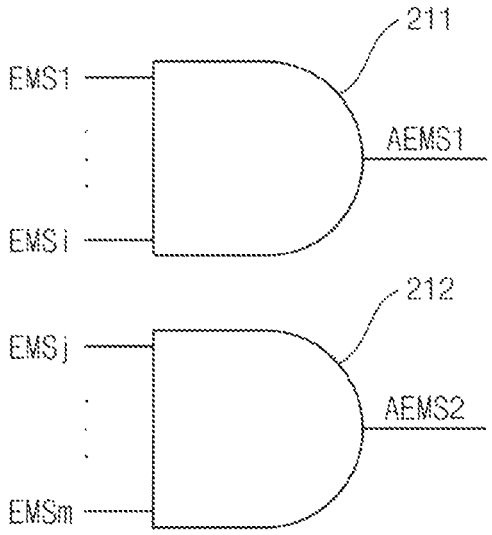
FIG. 3 is a diagram illustrating an example of a detection circuit included in the display panel of FIG. 2A.
Figure 4:
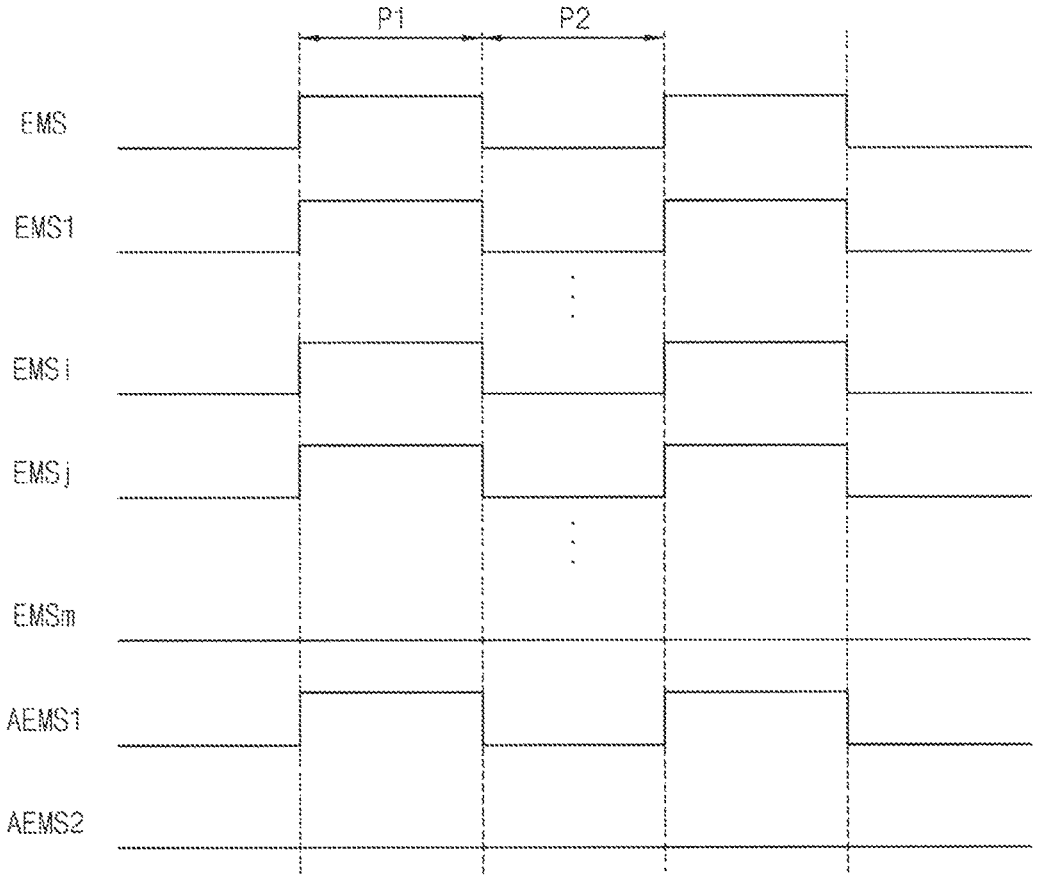
FIG. 4 is a waveform diagram illustrating an example of a detection signal generated by the detection circuit of FIG. 3.

FIG. 3 is a diagram illustrating an example of a detection circuit included in the display panel of FIG. 2A. FIG. 4 is a waveform diagram illustrating an example of a detection signal generated by the detection circuit of FIG. 3.

Referring to FIGS. 2A, 3 and 4, the first AND gate 211 may be implemented as an AND gate circuit (or a logic AND gate circuit) and may output a first detection signal AEMS1 (or a first sub detection signal) by performing a logic multiplication operation (AND) of the first through ith light emission detection signals EMS1 through EMSi.

When no crack occurs in the first through ith light emission control signal lines E1 through Ei, the first through ith light emission detection signals EMS1 through EMSi may have a waveform that is the same as a waveform of the light emission control signal EMS that is generated by the timing controller 160 or a reference signal. The light emission control signal EMS may have a logic high level (or a turn-off voltage level to turn off the second transistor T2 illustrated in FIG. 2A) in a first period P1 (or in an off duty) and may have a logic low level (or a turn-on voltage level to turn on the second transistor T2 illustrated in FIG. 2A) in a second period P2 (or in an on duty). As a width (or a length, a size) of the first period P1 increases, a light emission time of the pixels 111 may be shorten, and power consumption of the display device 100 may decrease.

The first AND gate 211 may output the first detection signal AEMS1 having a waveform that is the same as a waveform of the light emission control signal EMS.

Similarly, the second AND gate 212 may be implemented as an AND gate circuit (or a logic AND gate circuit) and output a second detection signal AEMS2 (or a second sub detection signal) by performing a logic multiplication operation (AND) of the jth through mth light emission detection signals EMSj through EMSm.

When a crack occurs in the mth light emission control signal line Em, the mth light emission detection signal EMSm (i.e., the mth light emission detection signal EMSm output through other end (or other terminal) of the mth light emission control signal line Em to the second AND gate 212) may have a waveform that is different from the waveform of the light emission control signal EMS (or a jth light emission control signal EMSj). For example, when the mth light emission control signal line Em is disconnected, the mth light emission detection signal EMSm may have a reference voltage level (e.g., a ground voltage level) that is constant in time.

The second AND gate 212 may output the second detection signal AEMS2 having a waveform that is different from the waveform of the light emission control signal EMS.

The display device 100 may detect an internal damage of the display panel 110 based on the first detection signal AEMS1 and/or the second detection signal AEMS2. For example, the display device 100 may compare the first detection signal AEMS1 and the second detection signal AEMS2 and determine that an internal damage has occurred in the display panel 110 when the first detection signal AEMS1 is different from the second detection signal AEMS2.

For example, the display device 100 may compare the first and second detection signal AEMS1 and AEMS2 with the light emission control signal EMS (or the reference signal) and determine an occurrence of an internal damage based on a result of comparison.

As described with reference to FIGS. 3 and 4, the detection circuit 210 may generate the detection signals AEMS1 and AEMS2 based on the light emission detection signals EMS1 through EMSm. Therefore, the display device 100 may detect an internal damage that may have occurred in the display panel 110.

It is illustrated in FIGS. 3 and 4 that the detection circuit 210 includes two AND gates. However, the detection circuit is not limited thereto. For example, the detection circuit 210 may include k number of AND gates, where k is greater than or equal to 3. For example, the detection circuit 210 may include the third AND gate described with reference to FIG. 2A and output a detection signal CDS to an external component (e.g., the timing controller 160) using the third AND gate. The number k of the AND gates may be determined based on a manufacturing cost of the display panel (or the display device 100).

Figure 5:
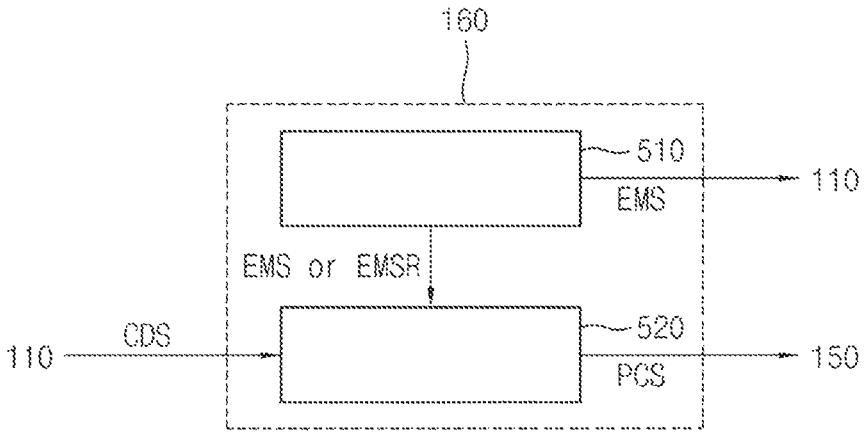
FIG. 5 is a block diagram illustrating an example of a timing controller included in the display device of FIG. 1.

FIG. 5 is a block diagram illustrating an example of a timing controller included in the display device of FIG. 1.

Referring to FIGS. 1 and 5, the timing controller 160 may include a signal generator 510 (or a signal generating unit) and a calculator 520 (or a calculating unit).

The signal generator 510 may generate the light emission control signal EMS. As described with reference to FIGS. 1 and 4, the light emission control signal EMS may have an off duty and may be used to control a light emission time of the pixels 111. The signal generator 510 may provide the light emission control signal EMS to the display panel 110 through the light emission control signal lines E1 through Em.

In some example embodiments, the signal generator 510 may generate a reference light emission control signal EMSR. In one embodiment, the reference light emission control signal EMSR may be the same as or substantially the same as the light emission control signal EMS. In another embodiment, the reference light emission control signal EMSR may be an inverted signal of the light emission control signal EMS. The reference light emission control signal EMSR may be used to determine whether or not a light emission detection signal is normal (or abnormal). For example, the reference light emission control signal EMSR may be provided to the calculator 520.

The calculator 520 may receive the detection signal CDS and generate a power control signal PCS based on the detection signal CDS. Here, the detection signal CDS may be one signal or may include the first detection signal AEMS1 and the second detection signal AEMS2 as shown in FIG. 4.

In some example embodiments, the calculator 520 may determine an occurrence of an internal damage of the display panel 110 by comparing the detection signal CDS and the light emission control signal EMS. For example, the calculator 520 may determine that no internal damage has occurred in the display panel 110 when the detection signal CDS is the same as the light emission control signal EMS. In another example, the calculator 520 may determine that an internal damage has occurred in the display panel 110 when the detection signal CDS is different from the light emission control signal EMS.

In some example embodiments, the calculator 520 may determine an occurrence of an internal damage of the display panel 110 based on the detection signal CDS and the reference light emission control signal EMSR. The reference light emission control signal EMSR may have a waveform opposite to a waveform of the light emission control signal EMS, and the reference light emission control signal EMSR may be an inverted signal of the light emission control signal EMS. For example, the calculator 520 may include an OR gate (or a logical OR gate, a logical sum operator) and perform a logical sum operation (OR) of the detection signal CDS and the reference light emission control signal EMSR. For example, the calculator 520 may determine that no internal damage has occurred in the display panel 110 when an output signal by the logical operation has a constant level (or a constant value). In another example, the calculator 520 may determine that an internal damage has occurred in the display panel 110 when an output signal by the logical operation has a level that changes in time.

In some example embodiments, the calculator 520 may generate a representative detection signal by performing a logical operation of the first detection signal AEMS1 and the second detection signal AEMS2 when the detection signal CDS includes the first detection signal AEMS1 and the second detection signal AEMS2. In this case, when detection signals are provided to the timing controller 160, the calculator 520 may be a pre-processor for processing the detection signal CDS and generate the representative detection signal by performing a logical operation of the detection signals. The calculator 520 may determine an occurrence of an internal damage of the display panel 110 based on the representative detection signal.

In some example embodiments, the calculator 520 may generate the power control signal PCS based on a result of determination (i.e., a determination result on whether or not an internal damage has occurred) and provide the power control signal PCS to the power supply 150. For example, the calculator 520 may output the power control signal PCS having a certain level (or a certain value) when the calculator 520 determines that an internal damage has occurred in the display panel 110. Here, the power supply 150 may stop a power supply (or a supply of the driving voltages) to the display panel 110. Therefore, the display device 100 may prevent a further damage to the display panel 110 caused by the internal damage.

As described with reference to FIG. 5, the timing controller 160 may determine an occurrence of an internal damage of the display panel 110 based on the detection signal CDS and control the power supply 150 by generating the power control signal PCS when the internal damage occurs in the display panel 110.

The present disclosure may be applied to any display device including an organic light emitting display device and a liquid crystal display device. For example, the present disclosure may be applied to a television, a computer monitor, a laptop, a digital camera, a cellular phone, a smart phone, a personal digital assistant (PDA), a portable multimedia player (PMP), an MP3 player, a navigation system, and a video phone.

The foregoing is illustrative of example embodiments, and is not to be construed as limiting thereof. Although a few example embodiments have been described, those skilled in the art would readily appreciate that many modifications and deviations are possible in the example embodiments without materially departing from the novel teachings and advantages of example embodiments. Accordingly, such modifications and deviations are intended to be included within the scope of example embodiments. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications and deviations to the disclosed example embodiments, as well as other example embodiments, are intended to be included within the scope of the present disclosure. The present disclosure may be defined by the following claims, with equivalents of the claims to be included therein.

What is claimed is:

1. A display panel comprising:

a plurality of pixels;

a plurality of light emission control signal lines configured to transfer a light emission control signal to variably control light emission times of the plurality of pixels through an end of the plurality of light emission control signal lines to the plurality of pixels, respectively; and a detection circuit configured to generate a detection signal based on light emission detection signals, the detection circuit being electrically connected to the other end of the plurality of light emission control signal lines, wherein the detection signal indicates an occurrence of an internal damage of the display panel, wherein the plurality of light emission control signal lines are different from data lines of the plurality of pixels, wherein the detection circuit generates a first detection signal based on a first light emission detection signal output from a first light emission control signal line of the plurality of light emission control signal lines and a second light emission detection signal output from a second light emission control signal line of the plurality of light emission control signal lines, wherein the detection circuit generates a second detection signal based on a third light emission detection signal output from a third light emission control signal line of the plurality of light emission control signal lines and a fourth light emission detection signal output from a fourth light emission control signal line of the plurality of light emission control signal lines, and wherein the detection circuit generates the detection signal based on the first detection signal and the second detection signal.

2. The display panel of claim 1, wherein the plurality of light emission control signal lines extend in a first direction and are arranged along a second direction perpendicular to the first direction.

3. The display panel of claim 2, wherein the detection circuit is located on a first side of the display panel.

4. The display panel of claim 1, wherein each of the plurality of pixels include:

a first transistor including a first electrode electrically connected to a first power voltage, a second electrode electrically connected to a first node, and a gate electrode receiving a data signal;

a second transistor including a first electrode electrically connected to the first node, a second electrode electrically connected to a second node, and a gate electrode receiving the first light emission control signal; and a light emission element electrically connected between the second node and a second power voltage.

5. The display panel of claim 1, wherein the detection circuit outputs the first detection signal by performing a logical multiplication operation of the first light emission detection signal and the second light emission detection signal.

6. The display panel of claim 5, wherein the detection circuit outputs the second detection signal by performing a logical multiplication operation of the third light emission detection signal and the fourth light emission detection signal.

7. The display panel of claim 6, wherein the detection circuit generates the detection signal by performing a logical multiplication operation of the first detection signal and the second detection signal.

8. The display panel of claim 7, wherein the detection circuit includes a logic gate element configured to receive the first detection signal and the second detection signal and to output the detection signal.

9. A display device comprising:

a display panel including plurality of pixels and a plurality of light emission control signal lines respectively transferring a light emission control signal to variably control light emission times of the plurality of pixels; and a logical gate driver configured to generate detection signal based on light emission detection signals, the logical gate driver being electrically connected to the other end of the plurality of light emission control signal lines; and a controller configured to generate the light emission control signal, to provide the light emission control signal to another end of the plurality of light emission signal lines, and to determine an occurrence of an internal damage based on the detection signal, wherein the plurality of light emission control signal lines are different from data lines of the plurality of pixels, wherein the logical gate driver generates the detection signal based on a first light emission detection signal output from a first light emission control signal line of the plurality of light emission control signal lines and a second light emission detection signal output from a second light emission control signal line of the plurality of light emission control signal lines, and wherein the controller compares the detection signal and a reference signal and determines that the internal damage has occurred in the display panel when a waveform of the detection signal is different from a waveform of the reference signal.

10. The display device of claim 9, wherein the plurality of light emission control signal lines extend in a first direction and are arranged along a second direction perpendicular to the first direction.

11. The display device of claim 9, wherein the controller includes:

a signal generator configured to generate the light emission control signal; and a determiner configured to determine the occurrence of the internal damage based on the detection signal.

12. The display device of claim 11, wherein the signal generator generates the reference signal having an inverted waveform with respect to a waveform of the light emission control signal, and wherein the determiner determines the occurrence of the internal damage by performing a logical operation of the detection signal and the reference signal.

13. The display device of claim 12, wherein the signal generator performs a logical sum operation of the detection signal and the reference signal.

14. The display device of claim 9, further comprising:

a power supply configured to provide driving voltages to the plurality of pixels, wherein the controller generates a power control signal to control a supply of the driving voltages based on a result of determination of the occurrence of the internal damage and provides the power control signal to the power supply.

* * * * *